United States Patent [19]

Tanimura et al.

[11] Patent Number: 4,617,982

[45] Date of Patent: Oct. 21, 1986

[54] METHOD OF AND APPARATUS FOR CONTINUOUSLY MANUFACTURING METAL PRODUCTS

[75] Inventors: Akira Tanimura, Kyoto; Hisayasu Tsubata, Uji; Shoji Tamamura, Nara, all of Japan

[73] Assignee: Unitika Ltd., Osaka, Japan

[21] Appl. No.: 629,613

[22] Filed: Jul. 11, 1984

[30] Foreign Application Priority Data

Jul. 18, 1983 [JP] Japan ..... 58-131177

[51] Int. Cl.[4] ..... B22D 11/06; B22D 11/10

[52] U.S. Cl. ..... 164/463; 164/423; 164/429; 164/437; 164/471; 164/475; 164/479; 164/488; 222/135; 222/591; 264/12

[58] Field of Search ..... 164/463, 471, 475, 479, 164/488, 423, 429, 437; 222/590, 591, 593, 135, 145, 146.5; 264/5, 12

[56] References Cited

U.S. PATENT DOCUMENTS

| | | | |
|---|---|---|---|
| 2,077,898 | 4/1937 | Rolff | 222/135 X |
| 2,313,056 | 3/1943 | Emerson et al. | 222/135 |
| 3,672,426 | 6/1972 | Cornish et al. | 164/463 X |
| 4,298,382 | 11/1981 | Stempin et al. | 164/463 X |
| 4,402,885 | 9/1983 | Roehrig et al. | 264/12 X |
| 4,433,715 | 2/1984 | Smith | 164/437 X |
| 4,449,568 | 5/1984 | Narasimhan | 164/423 X |
| 4,495,691 | 1/1985 | Masumoto et al. | 164/463 X |

FOREIGN PATENT DOCUMENTS

| | | | |
|---|---|---|---|
| 57-39062 | 3/1982 | Japan | 164/463 |
| 57-112956 | 7/1982 | Japan . | |
| 57-134251 | 8/1982 | Japan . | |

OTHER PUBLICATIONS

"Amorphous Alloys and Their Properties and Applications" (published in Japanese by Agune), 1981.

*Primary Examiner*—Nicholas P. Godici
*Assistant Examiner*—J. Reed Batten, Jr.
*Attorney, Agent, or Firm*—Joseph W. Farley

[57] ABSTRACT

Material is supplied from a pressure hopper made to have an inert gas atmosphere to each of a plurality of melting furnaces one after another in a predetermined amount each time. The interior atmosphere of each melting furnace is replaced by an inert gas, and the material is melted in the melting furnace by heating. The resulting molten metal is supplied from one of the melting furnaces after another to a discharge container having a discharge nozzle and made to have an inert gas atmosphere, and is continuously discharged from the discharge nozzle against a rapid quenching device.

13 Claims, 9 Drawing Figures

METHOD OF AND APPARATUS FOR CONTINUOUSLY MANUFACTURING METAL PRODUCTS

FIELD OF THE INVENTION

The present invention relates to a process and an apparatus for manufacturing metal products, and more particularly to a process and an apparatus for producing a thin metal strip, thin round metal wire, fine metal particles or like metal product directly from molten metal by rapid quenching.

BACKGROUND OF THE INVENTION

In recent years, extensive research has been conducted on techniques for producing thin metal strips, thin round metal wires or fine metal particles by melt-quenching processes, and various processes therefor have been proposed as disclosed, for example, in "Amorphous Alloys and Their Properties and Applications" (published in Japanese by Agune, 1981). These processes are in common in that the desired product is prepared by melting a specified metal material in a crucible and applying a pressure to the molten metal to discharge the metal against a quenching device from a nozzle attached to the bottom of the crucible. How to quench the metal discharged from the nozzle differs depending on the type of metal product (thin strip, thin round wire or fine particles) to be obtained. Various cooling methods for different types of products are proposed specifically in literature or publications. However, how to supply the molten metal is not disclosed in detail in these publications.

It is generally known to prepare metal products by measuring out several kinds of component materials for a specified alloy to obtain a mixture of specified composition, melting the mixture in a crucible and solidifying the molten mixture to prepare an alloy ingot first. Subsequently the ingot is placed into a discharge crucible, then melted again by heating and thereafter discharged in molten state from a nozzle with application of pressure afforded by an inert gas. However, the conventional process is practiced batchwise for preparing the alloy ingot, re-melting the ingot and discharging the molten metal and is therefore economically disadvantageous and in no way suited to commercial operation. More specifically stated, the conventional process has the following problems. (1) The process requires equipment for producing and storing alloy ingots. (2) Energy is required for re-melting the alloy ingot in the discharge crucible. (3) Because the process is batchwise, (a) the operation efficiency is low, (b) the quality of the product is likely to differ from batch to batch, and (c) a reduced yield will result when the portions of the batch resulting from an unstable operation at the start and end of the discharging or an uneven portion resulting from the variation of the molten metal level is excluded from the product.

Published Unexamined Japanese Patent Applications Nos. SHO 57-39062, SHO 57-112956 (claiming priority from U.S. application Ser. No. 220,561) and SHO 57-134251 (claiming priority from U.S. application Ser. No. 220,401) disclose details of improvements in apparatus for preparing metal products, but the disclosed apparatus similarly employ a batchwise process. Thus, the above problems still remain to be solved.

SUMMARY OF THE INVENTION

An object of the present invention is to provide a process and an apparatus for manufacturing metal products continuously and economically.

To fulfill the above object, the present invention provides a process for manufacturing a metal product comprising the steps of supplying a material or materials from pressure hopper means made to have an inert gas atmosphere to each of a plurality of melting furnaces one after another in a predetermined amount each time, replacing the interior atmosphere of each melting furnace by an inert gas, thereafter melting the material or materials in the melting furnace by heating, supplying the resulting molten metal from one of the melting furnaces after another to a discharge container having a discharge nozzle and made to have an inert gas atmosphere, and continuously discharging the molten metal from the discharge nozzle against a rapid quenching device.

The present invention further provides an apparatus suitable for practicing the above process. The apparatus comprises pressure hopper means for receiving a material or materials successively in a predetermined amount each time, a plurality of melting furnaces each adapted to receive the predetermined amount of material or materials from the pressure hopper means in turn for melting the material or materials by heating, a discharge container for receiving the resulting molten metal from one of the melting furnaces after another and continuously discharging the molten metal from a discharge nozzle, a rapid quenching device for solidifying the discharged molten metal from the nozzle by rapid quenching, and means for supplying an inert gas to the pressure hopper means, the melting furnaces and the discharge container.

DESCRIPTION OF THE PREFERRED EMBODIMENTS

Before describing embodiments of the present invention, a conventional metal product manufacturing apparatus will be described in detail with reference to FIGS. 1A and 1B.

Figure 1A:
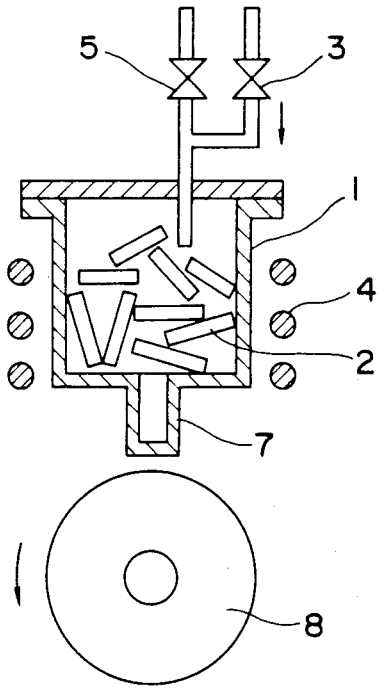
FIG. 1A PRIOR ART
FIG. 1A and FIG. 1B are views in vertical section schematically showing a conventional apparatus for manufacturing metal products.
Figure 1B:
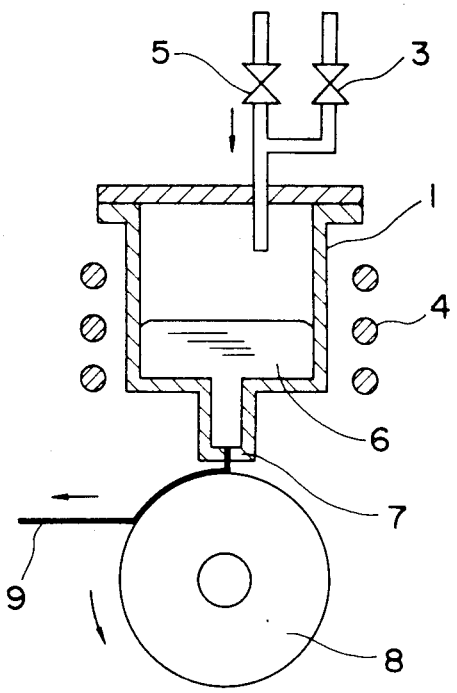
FIG. 1B PRIOR ART

Referring to FIG. 1A, alloy ingots 2 prepared in a melting crucible are placed into another melting crucible 1 and melted by opening a valve 3 for replacing the interior air by an inert gas and then passing an alternating current through an induction heating coil 4. After the alloy ingots have been melted, the valve 3 is closed and a valve 5 is opened for introducing a pressurizing inert gas into the crucible 1 as seen in FIG. 1B to apply a pressure to the molten metal 6, whereby the molten metal 6 is discharged from a nozzle 7 at the bottom of the crucible 1 into contact with the peripheral surface of a rotating metal roll 8 to produce a thin metal strip 9.

As already stated, such a conventional process is carried out invariably by a batchwise operation starting with the charging of alloy ingots and ending with the completion of discharge of the molten metal as one cycle, hence a low operation efficiency. If it is attempted to increase the amount of discharge per batch in order to improve the efficiency, objections will result. For example, the head of the molten metal surface relative to the nozzle end permits a leak of the metal through the nozzle before pressurization, or the rate of outflow of the molten metal varies with time to entail variations in the quality of the product. Furthermore, it is likely that the portions of product obtained immediately after the start of discharge of the molten metal and immediately before the completion of discharge will become a reject, or the quality of the product will vary from batch to batch.

The present invention, which has overcome these problems, will be described with reference to several embodiments.

Figure 2:
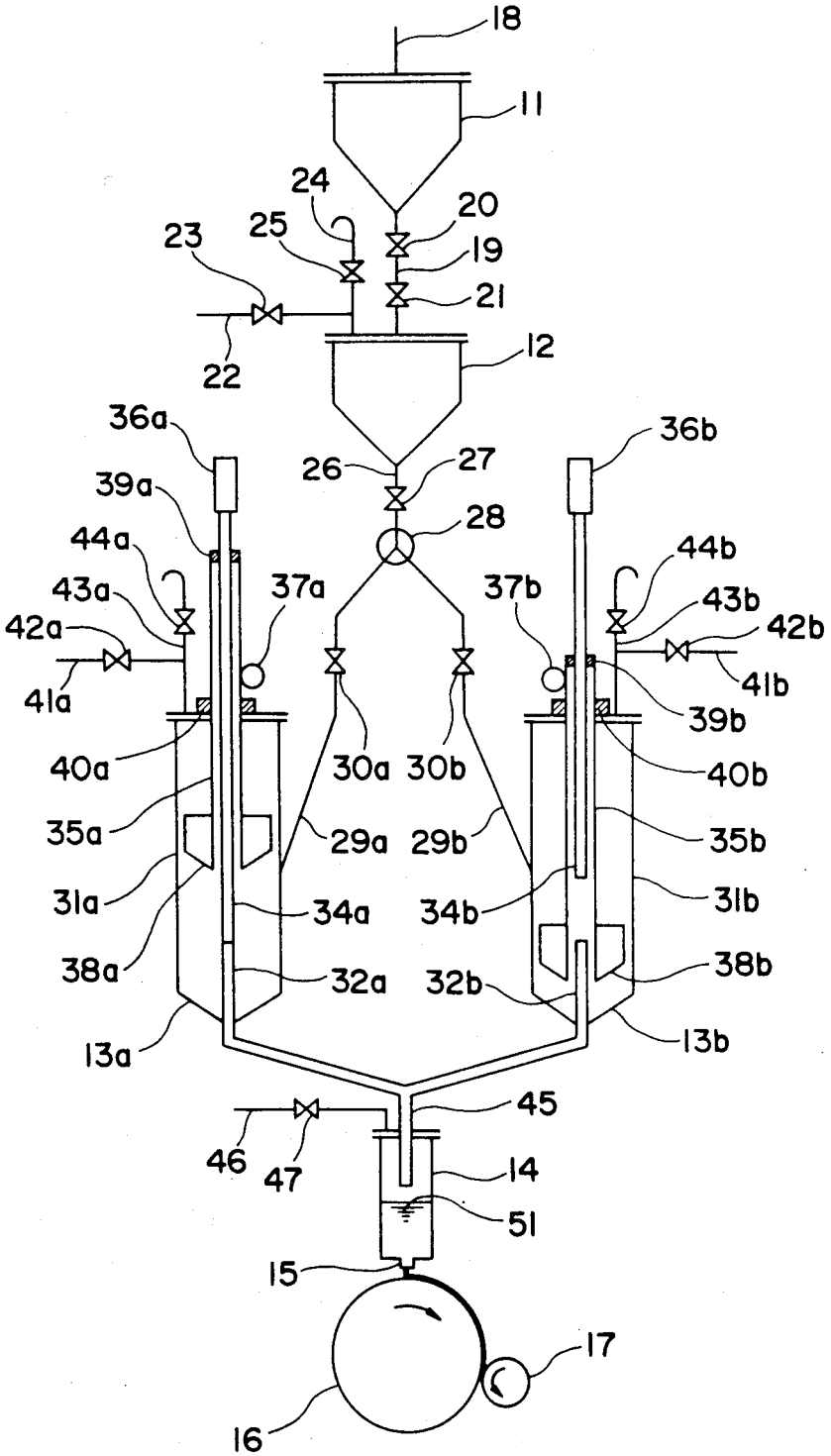
FIG. 2 is a view in vertical section schematically showing an apparatus embodying the invention for manufacturing metal products.

FIG. 2 shows a first embodiment of the invention in its entirety. The apparatus consists primarily of a material collection hopper 11, a pressure hopper 12, two melting furnaces 13*a* and 13*b*, a discharge container 14 having a discharge nozzle 15, a rapid cooling device 16 and a product take-up 17. Metal materials are fed to the collection hopper 11 via a supply duct 18. The collection hopper 11 is adapted to communicate with the pressure hopper 12 through a duct 19 provided with a discharge valve 20 and a sealing-off valve 21. The pressure hopper 12 is adapted to communicate with an inert gas supply source (not shown) through a supply pipe 22 having a supply valve 23 and with the outside through a vent pipe 24 having a vent valve 25. The outlet of the pressure hopper 12 is connected to a two-way valve 28 by a duct 26 provided with a discharge valve 27. Extending from the two-way valve 28 are ducts 29*a*, 29*b* respectively connected to the melting furnaces 13*a*, 13*b* and provided with sealing-off valves 30*a*, 30*b*.

The two melting furnaces 13*a*, 13*b* have exactly the same construction. (Accordingly the adscripts a and b will be omitted where unnecessary.) Each of the melting furnaces 13 has a main body 31 which is primarily made of a heat-resistant material. The lower portion of the main body 31 has an overflow duct 32 projecting thereinto and a heater 33 provided therearound. A valve stem 34 and a tubular member 35 surrounding the stem 34 extend through the upper end of the main body 31 and are movable upward and downward respectively by a first up-and-down drive unit 36 (indicated at 36*a* or 36*b* in FIG. 2) and a second up-and-down drive unit 37 having a speed control function. The tubular member 35 has at its lower end a cup 38 having a tapered bottom. The clearance between the valve stem 34 and the tubular member 35 is closed with a seal 39, while a seal 40 is fitted around the tubular member 35 at the upper end of the main body 31. The interior of the main body 31 is adapted to communicate with the above-mentioned inert gas supply source via a supply pipe 41 having a supply valve 42 and with the outside through a vent pipe 43 having a vent valve 44. Preferably a heat-resistant material, such as silicon nitride, is used for the components described and associated with the melting furnace 13 at the portions thereof to be exposed to molten metal and neighboring portions. The portions which are less susceptible to the influence of heat may be made of stainless steel or like material which is easy to machine. An air cylinder, for example, is usable as the first up-and-down drive unit 36, while the combination of a servomotor and rack-and-pinion, for example, is usable as the second up-and-down drive unit 37. When required, the melting furnace 13 can be provided with auxiliary parts, for example, for heat insulation or for cooling the seals 39 and 40.

The two overflow ducts 32*a*, 32*b* are joined together into a molten metal pouring duct 45 having a lower end projecting into the discharge container 14. The discharge container is adapted to communicate with the aforementioned inert gas supply source through a supply pipe 46 having a supply valve 47. Accordingly the pressure hopper 12, the melting, furnaces 13*a*, 13*b* and the discharge container 14 can be maintained at the same internal pressure by the common inert gas supply source.

The metal product manufacturing apparatus of the foregoing construction operates in the following manner.

First, materials for a metal, for example, several kinds of alloy components in the form of pellets of suitable size are automatically or manually weighed out in the desired proportions by weight and then charged into the collection hopper 11 with the discharge valve 20 and the sealing-off valve 21 closed. The pellets are temporarily held in the collection hopper 11 in preparation for charging into the pressure hopper 12.

Next, for the transfer of the pellets to the pressure hopper 12, the inert gas supply valve 23, the discharge valve 27 and the sealing-off valves 30*a*, 30*b* are closed, the vent valve 25 is opened, and the sealing-off valve 21 and the discharge valve 20 are then opened. The whole of the pellets stored in the collection hopper 11 are transferred to the pressure hopper 12, whereupon the discharge valve 20 and the sealing-off valve 21 are closed. Subsequently, to replace the interior atmosphere by an inert gas, the gas supply valve 23 and the vent valve 25 are alternately opened and closed a required number of times. With the vent valve 25 thereafter closed and the gas supply valve 23 held open, the pressure hopper 12 is pressurized to the same pressure as the melting furnace 13*a*, 13*b* and the discharge container 14. After the collection hopper 11 is empty with the whole charge placed into the pressure hopper 12, pellets are similarly placed into and held in the hopper 11 in preparation for transfer to the pressure hopper 12.

Figure 3A:
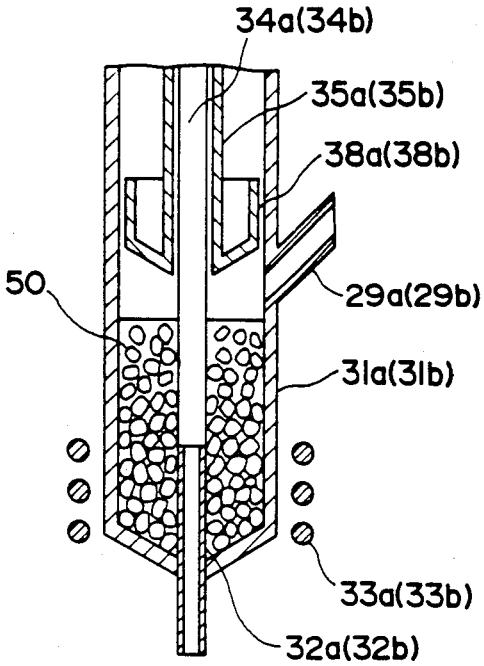
FIG. 3A to FIG. 3D are fragmentary views in vertical section schematically showing a melting furnace of the apparatus in different stages of operation.
Figure 3B:
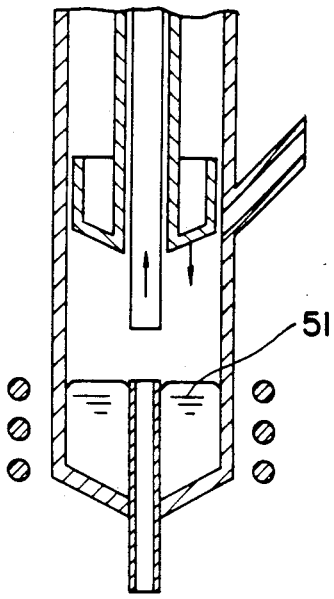
Figure 3C:
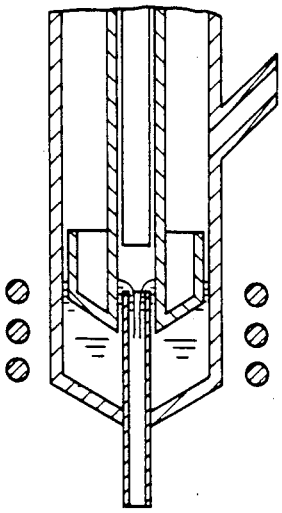
Figure 3D:
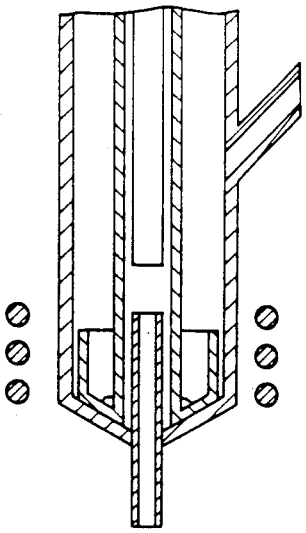

Next, to supply the charge from the pressure hopper 12 to the melting furnace 13*a*, the sealing-off valve 30*a* and the discharge valve 27 are opened, with the cup 38*a* held in a raised position as seen in FIG. 3A and with the two-way valve 28 opened for the furnace 13*a*. Consequently the pellets pass through the duct 29*a* and are received in the furnace main body 31*a* as indicated at 50. Before charging, the valve stem 34*a* is lowered to close the open end of the overflow duct 32*a* so as not to permit pellets 50 to fall into the duct 32*a*. When charging is completed, the sealing-off valve 30*a* is closed, and the heater 33*a* is operated to melt the pellets 50 into a molten metal 51. As shown in FIG. 3B, the liquid level of the metal 51 is slightly lower than the upper end of the overflow duct 32*a*. The charge to be loaded into the pressure hopper 12 is of course so determined that the liquid level of the molten metal 51 will be at such a position. Completion of melting is detected by a thermometer or level gauge (not shown), whereupon the valve stem 34*a* is raised and, at the same time, the cup 38*a* is lowered close to the surface of the molten metal 51 as shown in FIG. 3B and waits an instruction for discharging. The temperature of molten metal 51 is controlled to a constant level by feeding back the output from the thermometer. Subsequently, in response to a discharge instruction, the cup 38*a* starts descending at a predetermined speed as shown in FIG. 3C. After the bottom of the cup 38*a* has reached the surface of the molten metal 51, the liquid level rises by an amount corresponding to the volume of the metal displaced by the cup 38*a*, permitting the molten metal 51 to flow over the upper edge of the overflow duct 32*a* into the duct, with the result the metal flows through the duct 45 into the discharge container 14 (FIG. 2). The container 14 is also provided with sensors (not shown) for detecting the level and temperature of the molten metal 51, such that the descending speed of the cup 38*a* is controlled to control the amount of the metal flow from the melting furnace 13*a*. Thus the molten metal 51 in the container is maintained at a specified level and a constant temperature. Since it is extremely important to maintain the molten metal at a constant temperature within the container 14, it should preferably be provided with a heating device of its own. When the descending cup 38*a* reaches the lowermost position as shown in FIG. 3D, the molten metal 51 in the melting furnace 13*a* is almost entirely discharged therefrom into the container 14. In response to a further instruction the melting furnace 13*b* having molten metal similarly formed therein alternatively starts supply of the molten metal into the discharge container 14.

By repeating the above procedure, the molten metal is continuously supplied from the melting furnaces 13*a*, 13*b* to the discharge container 14 and further continuously discharged from the container 14 through its nozzle 15 into contact with the rapid quenching device 16, whereby the molten metal is continuously made into a metal product upon solidification by rapid quenching. The product is continuously wound on the take-up 17. During the above operation, the inert gas supply valve 47 is held open at all times, causing the gas pressure to discharge the molten metal from the container via the nozzle 15.

When the descending cup 38 is immersed in the molten metal 51 as shown in FIG. 3C, the slag or the like produced by the melting of pellets and floating on the surface of the molten metal is forced toward the inner wall surface of the furnace main body 31 by the tapered bottom portion of the cup 38 without flowing into the overflow duct 32. Further when the cup 38 is at the lowermost end of the furnace main body 31, the upper outer brim of the cup 38 is at a slightly lower level than the upper end of the overflow duct 32 as seen in FIG. 3D, so that the slag or the like flows over the brim into the cup 38 and can be accommodated therein. The cup has a capacity sufficient to accommodate the amount of slag that will result from repeated melting and discharge of the charge. The slag accumulated is removed from the cup after completion of a run or during shutdown.

Although the illustrated embodiment comprises two melting furnaces 31*a*, 31*b*, three or more melting furnaces may be used. In such a case, at least two material collection hoppers and at least two pressure hoppers may be provided as interconnected by a branch duct. While the present embodiment employs a single roll method for rapid quenching, other quenching methods are usable which include, for example, a twin roll method, centrifugal method and in-rotating-liquid spinning method.

Metal materials useful for the present invention are pure metals, metals containing traces of impurities and various alloys. Especially preferable are alloys which exhibit outstanding properties when solidified by rapid quenching, such as alloys which form an amorphous phase, those which form a non-equilibrium crystalline phase, etc. Examples of alloys which form an amorphous phase are disclosed, for example, in "Science," No. 8, 1978, pp. 62–72, "Transactions of the Japan Institute of Metals," Vol. 15, No. 3, 1976, pp. 151–206, "Kinzoku (Metals)," Dec. 1, 1971, pp. 73–78 and like literature, Published Unexamined Japanese Patent Applications Nos. SHO 49-91014, SHO 50-101215, SHO 49-135820, SHO 51-3312, SHO 51-4017, SHO 51-4018, SHO 51-4019, SHO 51-65012, SHO 51-73920, SHO 51-73923, SHO 51-78705, SHO 51-79613, SHO 52-5620, SHO 52-114421, SHO 54-99035 and various other patent publications. Of these alloys, typical of those having high ability to form an amorphous phase and practically useful are of the Fe-Si-B type, Fe-P-C type, Fe-P-B type, Co-Si-B type, Ni-Si-B type, etc. Needless to say, suitable alloys can be selected from among numerous alloys comprising metal-semimetal combinations and metal-metal combinations. Moreover, an alloy having oustanding characteristics which can not be afforded by conventional crystalline metals can be prepared making use of the feature of such composition. Examples of alloys which form a non-equilibrium crystalline phase are Fe-Cr-Al alloys and Fe-Al-C alloys disclosed in "Tetsu to Koh (Iron and Steel)," Vol. 66, No. 3, 1980, pp. 382–389, "Journal of the Japan Institute of Metals," Vol. 44, No. 3, 1980, pp. 245–254, "Transactions of the Japan Institute of Metals," Vol. 20, No. 8, Aug. 1979, pp. 468–471, and "Summary of General Lectures at Fall Meeting of the Japan Institute of Metals," Oct. 1979, pp. 350 and 351, and Mn-Al-C alloys Fe-Cr-Al alloys, Fe-Mn-Al-C alloys, etc. disclosed in "Summary of General Lectures at Fall Meeting of the Japan Institute of Metals," Nov. 1981, pp. 423–425.

Because of the foregoing features, the process and apparatus of the invention have various advantages as given below.

(1) Metal products can be manufactured continuously by rapid quenching.

(2) The equipment conventionally needed for producing and storing alloy ingots can be dispensed with. This greatly reduces the space for the installation of the equipment and the construction cost.

(3) The energy cost conventionally needed for remelting alloy ingots can be saved.

(4) The continuous operation assures an improved efficiency, reduces variations in the quality of products and achieves higher yields.

(5) The apparatus can be of simple construction and permits flow control for the molten metal without using heat and wear-resistant flow regulating valves which are usually difficult to make, so that heat-resistant materials of good properties (ceramics, etc.) are usable for building practically useful equipment.

The invention will be described in greater detail with reference to the following examples.

EXAMPLE 1

To obtain an alloy comprising $Fe_{75}Si_{10}B_{15}$ (the subscripts being atomic %), pellets of the alloy components, i.e. Fe, Si and B, were weighed out in the proportions by weight of 90.4%, 6.1% and 3.5%, respectively. The mixture (10 kg) was charged into the collection hopper 11 of the apparatus shown in FIG. 2 through the duct 18, with the discharge valve 20 and the sealing-off valve 21 held closed. Next, the inert gas supply valve 23, the discharge valve 27 and the sealing-off valves 30*a*, 30*b* were closed, the vent valve 25 was opened, and the sealing-off valve 21 and the discharge valve 20 were thereafter opened to transfer the whole of the pellets from the collection hopper 11 to the pressure hopper 12. The discharge valve 20 and the sealing-off valve 21 were then closed. To replace the interior atmosphere of the pressure hopper 12 by an inert gas, the vent valve 25 and the gas supply valve 23 were alternately opened and closed five times, giving an inert gas pressure of 4.5 kg/cm$^2$, whereupon the vent valve 25 was closed. With the gas supply valve 23 held open to maintain the inert gas pressure of 4.5 kg/cm$^2$, the discharge valve 27 was opened, the two-way valve 28 was opened for the melting furnace 13*a*, and the sealing-off valve 30*a* was opened. Consequently, the 10 kg quantity of the charge was wholly transferred from the pressure hopper 12 to the melting furnace 13*a* through the duct 29*a*. The sealing-off valve 30*a* was thereafter closed. The gas supply valve 42*a* and the vent valve 44*a* were alternately opened and closed five times. Finally the apparatus was allowed to stand for about 10 minutes, with the vent valve 44*a* closed and with the supply valve 42*a* held open, in preparation for the start of heating. In the meantime, the air in the discharge container 14 communicating with the melting furnaces 13*a*, 13*b* was driven out by the flow of inert gas through the nozzle 15 at the lower end of the container 14, whereby the atmosphere in the entire system was replaced by the inert gas. Subsequently the heater 33*a* (FIG. 3A) for the melting furnace 13*a* was energized to melt the charge in the furnace 13*a* under such control that the temperature of the charge finally reached 1300° C. At the same time, the cup 38*a* was initiated into downward movement, causing the molten metal to flow over the upper edge of the overflow duct 32*a* into the duct and further flow into the discharge container 14 through the duct 45. The molten metal, which was subjected to the pressure of 4.5 kg/cm$^2$ within the container 14, was immediately discharged from the lower end nozzle 15 having an orifice diameter of 0.2 mm. At this time, the molten metal was discharged at a rate of 1 g/hole/sec. Initially the rate of flow of the molten metal into the discharge container 14 was made higher than this rate, such that the descending speed of the cup 38*a* was so controlled that the liquid level of the molten metal 51 within the container 14 would progressively rise. When the liquid level reached the approximate midportion of the container 14, the cup 38*a* was slowed down. The descending speed was thereafter so controlled that the molten metal flowed into the container 14 at the same rate as when flowing out from the nozzle 15 to maintain the molten metal at a constant liquid level within the container 14. Strictly speaking, the initial rate of discharge from the nozzle 15 of the container 14 increased with the rise of the liquid level, by an amount corresponding to the difference in level due to the rise, but the increase was so small as to be negligible.

Subsequently, while the molten metal was still flowing from the melting furnace 13*a* into the discharge container 14, another 10 kg of the same alloy component pellets as above was introduced into the collection hopper 11 and transferred therefrom into the pressure hopper 12 in the same manner as above. The two-way valve 28 was then opened for the melting furnace 13*b* and the charge was further transferred into the furnace 13*b*. The sealing-off valve 27 was thereafter closed, the gas supply valve 42*b* and the vent valve 44*b* were alternately opened and closed five times, and the heater 33*b* was operated for heating, with the vent valve 44*b* closed and the gas supply valve 42*b* held open. During these operations, the open end of the overflow duct 32*b* is held closed by the lowered valve stem 34*b*. When the charge melted and reached the state in which the charge was to be maintained at a controlled temperature of 1300° C., the cup 38*b* was initiated into downward movement simultaneously with lifting of the valve stem 34*b*, causing the molten metal to flow over the upper end of the overflow duct 32*b* into the duct and to further flow into the discharge container 14 through the duct 45. At the same time, the descending cup 38*a* was stopped to discontinue the flow of molten metal from the melting furnace 13*a* into the discharge container 14 and to replace this flow by the flow of molten metal from the melting furnace 13*b* into the container 14. The timing was adjusted to assure the replacement or change-over smoothly.

Next, still another 10 kg quantity of charge was placed into the collection hopper 11 in the same manner as above, and the cycle of: transfer to the pressure hopper 12→transfer to the melting furnace 13→melting→transfer of molten metal to the discharge container 14 was repeated alternately for the systems a and b, whereby the molten metal was continuously discharged from the nozzle 15 over a long period of time. The discharged molten metal was solidified by rapid quenching with a cooling drum 16 having a diameter of 300 mm, disposed immediately below the nozzle in close proximity thereto and driven at 2000 r.p.m., whereby the metal was made into a continuous thin strip, 2.5 mm in width and 0.03 mm in thickness, which was continuously wound on the take-up 17.

The melting-solidifying cycle was repeated five times by each of the systems a and b, i.e. 10 times in total, affording 100 kg of continuous thin strip in about one hour. When checked by the usual X-ray diffractiometry, the thin strip obtained was found to be of amorphous material.

EXAMPLE 2

Figure 4:
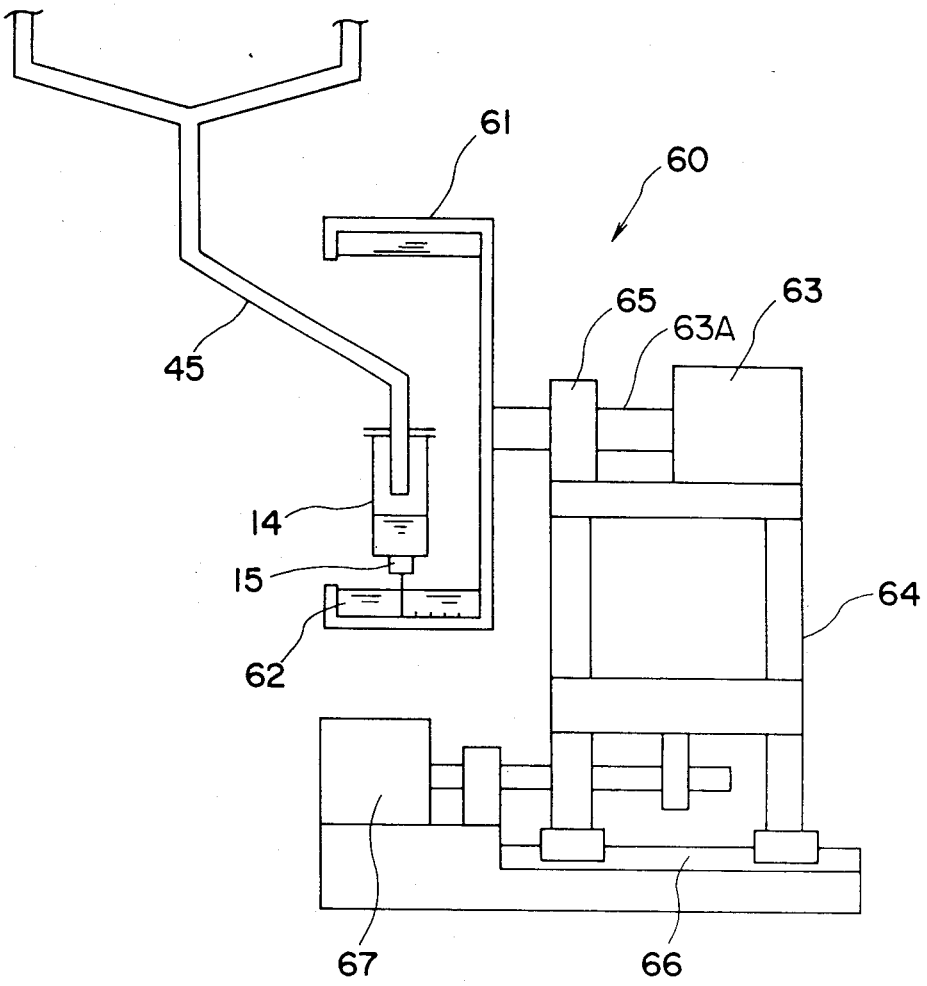
FIG. 4 is a fragmentary view in vertical section schematically showing another apparatus embodying the invention for manufacturing metal products.

The cooling drum 16 of the apparatus of FIG. 2 used in Example 1 was replaced by a rapid quenching device 60 as shown in FIG. 4 to effect rapid quenching by the in-rotating-liquid spinning process. The apparatus 60 comprises a rotary drum 61 open at one side thereof and having a diameter of 500 mm for centrifugally forming a quenching bath layer 62 on its inner periphery. The rotary drum 61 is rotated through a rotary shaft 63A by a drive motor 63 mounted on a frame 64. The rotary shaft 63A is rotatably supported by a bearing 65 fixedly mounted on the frame 64. The frame 64 is supported on a pair of rails 66 and is reciprocatingly movable thereon by a frame drive motor 67. A discharge container 14 is disposed inside the rotary drum 61 and has a nozzle 15 with an orifice diameter of 0.15 mm. With the exception of the above arrangement, the apparatus of FIG. 4 has substantially the same construction as the one shown in FIG. 2.

The rotary drum 61 was driven at 350 r.p.m. by the motor 63 and, at the same time, the frame 64, i.e. the rotary drum 61, was reciprocatingly moved by the motor 67. Consequently the molten metal discharged from the nozzle 15 was solidified into a thin wire by rapid quenching and wound over the inner periphery of the drum 61 in layers. The charge melting-solidifying cycle was repeated two times by each of the systems a and b, i.e. four times in total, over a period of about 10 hours. Thus, the product was obtained under exactly the same conditions as in Example 1 with the exception of the above conditions.

The continuous thin metal wire taken up on the rotary drum 61 in layers was 0.15 mm in diameter and 40 kg in total weight and had a circular cross section which was uniform longitudinally of the wire. When checked by the usual method of X-ray diffractiometry, the thin wire was found to be of amorphous material.

EXAMPLE 3

A thin metal wire was produced under the same conditions as in Example 2 with the exception of using materials for forming an alloy having the composition of $Fe_{78}Ni_3Cr_{10}Al_6C_3$ (the subscripts being atomic %) and melting the charge at 1400° C.

The wire was continuous, 0.15 mm in diameter and about 40 kg in total weight and had a uniformly dispersed fine crystalline structure and a substantially circular cross section which was uniform longitudinally thereof.

EXAMPLE 4

A thin metal wire was produced under the same conditions as in Example 2 with the exception of using materials for forming an alloy having the composition of $Co_{75}Si_{10}B_{15}$ (the subscripts being atomic %), melting the charge at a temperature of 1320° C., using a nozzle with an orifice diameter of 0.13 mm as the nozzle 15 of FIG. 4 and driving the rotary drum 61 at 318 r.p.m.

The wire was continuous, of amorphous material, 0.12 mm in diameter and about 40 kg in total weight and had a substantially circular cross section which was uniform longitudinally of the wire.

EXAMPLE 5

Figure 5:
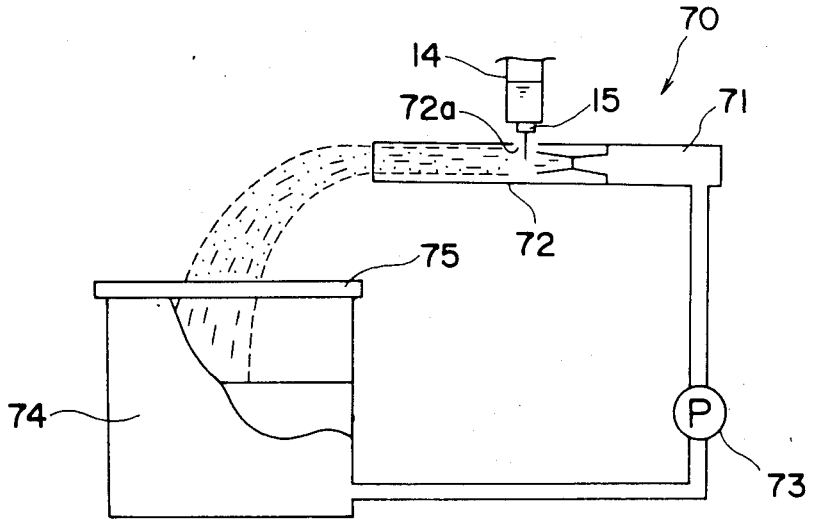
FIG. 5 is a fragmentary view in vertical section schematically showing another apparatus embodying the invention for manufacturing metal products.

The quenching drum 16 of the apparatus shown in FIG. 2 and used in Example 1 was replaced by a rapid quenching device 70 as schematically shown in FIG. 5 to produce fine metal particles. The apparatus 70 comprises a jet nozzle 71 for forming a jet of quenching liquid. The jet nozzle 71 is provided with a guide cylinder 72 having an opening 72*a*. The quenching liquid is supplied from tank 74 to the jet nozzle 71 by the action of a pump 73. The jet of quenching liquid forced out from the nozzle 71 atomizes, rapidly cools and solidifies the molten metal discharged from the nozzle 15 of a discharge container 14 and admitted into the cylinder 72 through the opening 72*a*. The solidified fine metal particles entrained by the jet stream are separated from the quenching liquid by a filter 75 provided over an upper end opening of the tank 74.

A molten metal was continuously discharged from the nozzle 15 in the same manner as in Example 1 except that the melting temperature was 1400° C. and that the nozzle 15 of the discharge container 14 had an orifice diameter of 0.08 mm. Water having a temperature of 5° C. was used as the quenching liquid to form a water jet having a flow speed of 3500 m/min by the jet nozzle 71, whereby the molten metal was atomized, rapidly cooled and solidified to continuously produce fine metal particles.

Eighty percent by weight of the fine particles obtained were in the range of 151 to 200 μm in size. The product was found to be of amorphous material when checked by X-ray diffractiometry.

What is claimed is:

1. A process for manufacturing a metal product comprising the steps of supplying material for the product from pressure hopper means to each of a plurality of melting furnaces one after another in a predetermined amount each time, replacing the interior atmosphere of each melting furnace by an inert gas at a predetermined pressure, thereafter heating the material in the melting furnaces to form a molten metal, supplying the resulting molten metal from one of the melting furnaces after another to a discharge container having a discharge nozzle and made to have an inert gas atmosphere at substantially the same pressure as the pressure within the melting furnace from which the molten metal is being supplied, and continuously discharging the molten metal through the discharge nozzle against a rapid quenching device, the supplying of the molten metal to the discharge container from each melting furnace being conducted in a manner such that the surface of the molten metal within the discharge container is maintained at a substantially constant level except when the discharge of the molten metal against the rapid quenching device is initiated.

2. A process as defined in claim 1 wherein the material comprises pellets of alloy components in predetermined proportions for preparing an amorphous alloy.

3. A process as defined in claim 1 wherein the material comprises pellets of alloy components in predetermined proportions for preparing a non-equilibrium crystalline alloy.

4. A process as defined in claim 1 wherein the pressure hopper means is made to have an inert gas atmosphere at substantially the same pressure as the pressure within the melting furnace to which the material is being supplied.

5. An apparatus for manufacturing a metal product comprising pressure hopper means for receiving material for the product successively in a predetermined amount each time, a plurality of melting furnaces each adapted to receive the predetermined amount of material from the pressure hopper means in turn for heating the material to form a molten metal, a discharge container for receiving the resulting molten metal from one of the melting furnaces after another and continuously discharging the molten metal through a discharge nozzle, a rapid quenching device for solidifying the discharged molten metal from the nozzle by rapid quenching, means for supplying the molten metal within each melting furnace to the discharge container in a manner such that the surface of the molten metal within the discharge container is maintained at a substantially constant level except when the discharge of the molten metal against the rapid quenching device is initiated, and means for supplying an inert gas to at least the melting furnaces and the discharge container in a manner such that the pressure within the discharge container is substantially the same as the pressure within the melting furnace from which the molten metal is being supplied.

6. An apparatus as defined in claim 5 wherein the rapid quenching device comprises a rotary cooling drum having an outer peripheral surface to which the molten metal is applied.

7. An apparatus as defined in claim 5 wherein the rapid quenching device comprises a rotary drum formed in its one side with an opening for the discharge container to be placed in, the rotary drum being adapted to centrifugally form a cooling bath layer on its inner periphery.

8. An apparatus as defined in claim 5 wherein the rapid quenching device has a jet nozzle for forming a jet of cooling liquid for the molten metal from the discharge nozzle to impinge on.

9. An apparatus as defined in claim 5 wherein the inert gas supplying means is adapted to supply an inert gas also to the pressure hopper means in a manner such that the pressure within the pressure hopper means is substantially the same as the pressure within the melting furnace to which the material is being supplied.

10. An apparatus as defined in claim 5 wherein the molten metal supplying means comprises an overflow duct extending into each melting furnace from the lower end thereof and means for causing the molten metal within the furnace to overflow into the overflow duct.

11. An apparatus as defined in claim 5 wherein the molten metal supplying means comprises an overflow duct extending into each melting furnace from the lower end thereof and an annular cup movable upward and downward within the melting furnace and having a tapered lower portion, the cup having an upper outer brim positioned at a lower level than the upper end of the overflow duct when the cup is lowered to its lower limit position.

12. An apparatus as defined in claim 11 wherein each of the melting furnaces is provided with a valve stem extending through the upper end of the melting furnace and aligned with the overflow duct and a tubular member extending through the upper end of the melting furnace around the valve stem and having the cup attached to its lower end, the valve stem and the tubular member being movable upward and downward by first and second up-and-down drive units, respectively.

13. An apparatus as defined in claim 11 wherein the overflow duct of each of the melting furnaces is joined to a duct extending into the discharge container.

* * * * *